US008695854B2

(12) United States Patent
Hartley et al.

(10) Patent No.: US 8,695,854 B2
(45) Date of Patent: Apr. 15, 2014

(54) BULK CONTAINER SWEEP ELBOW

(75) Inventors: Michael Dean Hartley, Beatrice, NE (US); Scott T. Meints, Katy, TX (US)

(73) Assignee: Hoover Materials Handling Group, Inc., Houston, TX (US)

( * ) Notice: Subject to any disclaimer, the term of this patent is extended or adjusted under 35 U.S.C. 154(b) by 1771 days.

(21) Appl. No.: 11/906,229

(22) Filed: Oct. 1, 2007

(65) Prior Publication Data

US 2009/0084800 A1 Apr. 2, 2009

(51) Int. Cl.
*B67D 7/06* (2010.01)

(52) U.S. Cl.
USPC ..... 222/185.1; 222/575

(58) Field of Classification Search
USPC ..... 222/181.1–185.1, 575
See application file for complete search history.

(56) References Cited

U.S. PATENT DOCUMENTS 4,960,227 A * 10/1990 Coleman ..... 222/94
5,833,120 A * 11/1998 Evans et al. ..... 222/95
6,682,108 B1 * 1/2004 Arch ..... 285/365

* cited by examiner

*Primary Examiner* — Daniel R Shearer
(74) *Attorney, Agent, or Firm* — Wood, Phillips, Katz, Clark & Mortimer

(57) ABSTRACT

An intermediate bulk container (IBC) for storing and offloading materials comprises a portable tank including a bottom wall having a bottom discharge outlet. A discharge assembly comprises a sweep elbow and an outlet valve. The sweep elbow has an inlet connected to the discharge outlet and an outlet connected to the outlet valve. A bottom interior surface of the sweep elbow proximate the sweep elbow outlet is substantially even with a valve opening inside the outlet valve.

20 Claims, 4 Drawing Sheets

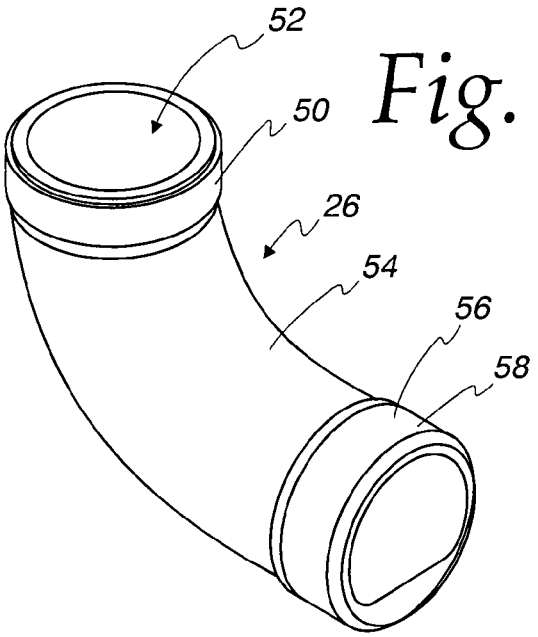
Fig. 4
Fig. 5
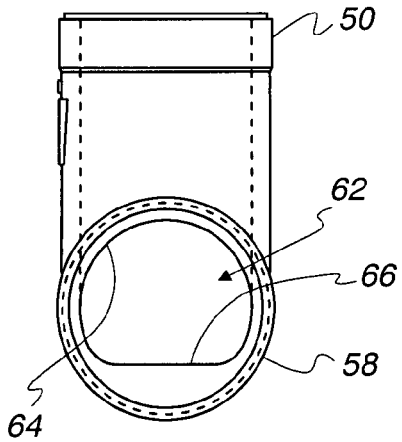
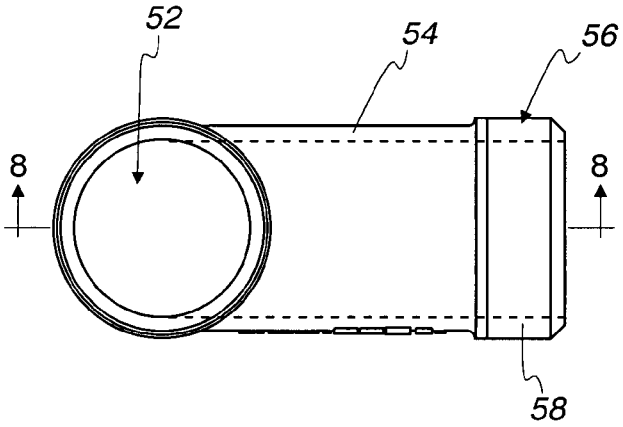
Fig. 6
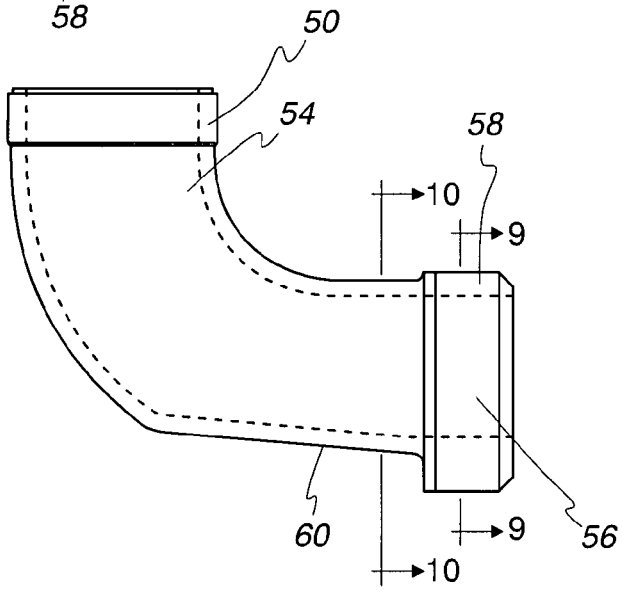
Fig. 7

BULK CONTAINER SWEEP ELBOW

CROSS REFERENCE TO RELATED APPLICATIONS

There are no related applications.

FIELD OF THE INVENTION

The present invention relates to a bulk container and, more particularly, to a sweep elbow used with an intermediate bulk container.

BACKGROUND OF THE INVENTION

Bulk packaging containers have found widespread use for storage and shipment of bulk goods. The bulk packaging containers assume many different forms. Among these forms are portable tanks and intermediate bulk containers (IBC). Requirements for these types of containers are outlined in various D. O. T. and F. D. A. regulations and are particularly defined in 49CFR Section 171.8.

Among IBCs, there include numerous types of designs. These include metal IBCs, which are constructed of metal, rigid plastic IBCs which are constructed of all-plastic material, and composite IBCs which include a rigid outer package enclosing a plastic inner receptacle.

An IBC typically has a capacity in the range of 250-550 gallons. Some are as large as 793 gallons. As such, they are an efficient alternative to 55-gallon drums. Nevertheless, each IBC must be handled and transported individually when used, for example, in the export of materials. The IBC is typically loaded into a shipping vessel. Each IBC must be individually slung by a crane or carried by a forklift during the loading and unloading.

Typically, an IBC is filled through a top fill opening. Discharge is provided through a bottom opening defining a discharge outlet. Complete drainage of the IBC is desirable to avoid waste. Often, a bottom wall of the IBC slopes toward the discharge outlet to provide maximum drainage. An elbow connects the discharge outlet to a valve, such as a ball valve. The elbow is sized for the opening and is typically a two inch elbow connecting to a two inch ball valve. With such a structure, the bottom surface of the elbow is usually below the ball opening of the ball valve. This can cause product to be trapped or sit in the elbow after discharging is complete.

The present invention is directed to improvements in IBC drainage.

SUMMARY OF THE INVENTION

In accordance with the invention, there is provided an improved sweep elbow for an intermediate bulk container.

In accordance with one aspect of the invention, there is disclosed an improvement in an intermediate bulk container (IBC) for storing materials and including a bottom wall having a bottom discharge outlet and an outlet valve for connection to the discharge outlet. The improvement comprises a sweep elbow connected between the discharge outlet and the outlet valve. The sweep elbow has a circular cross sectional configuration at an inlet connected to the discharge outlet and has a segment of a circle cross sectional configuration at an outlet connected to the outlet valve.

It is a feature of the invention that the segment of a circle defines a cord substantially tangential to a bottom of an opening of the outlet valve.

It is another feature of the invention that the elbow has a bottom interior surface proximate the outlet substantially even with a valve opening inside the outlet valve. The bottom interior surface may be generally planar and slopes downwardly toward the outlet.

It is a further feature of the invention that the sweep elbow is of stainless steel construction.

There is disclosed in accordance with another aspect of the invention, an apparatus comprising a bottom wall having a discharge outlet, a sweep elbow having an inlet connected to the discharge outlet and an outlet connected to an outlet valve. A bottom interior surface of the sweep elbow proximate the sweep elbow outlet is substantially even with a valve opening inside the outlet valve.

It is a feature of the invention that the outlet valve comprises a ball valve.

There is disclosed in accordance with a further aspect of the invention an IBC comprising a portable tank including a bottom wall having a bottom discharge outlet and a discharge assembly. The discharge assembly comprises a sweep elbow and an outlet valve. The sweep elbow has an inlet connected to the discharge outlet and an outlet connected to the outlet valve. A bottom interior surface of the sweep elbow proximate the sweep elbow outlet is substantially even with a valve opening inside the outlet valve.

Further features and advantages of the invention will be apparent from the specification and the drawings.

BRIEF DESCRIPTION OF THE DRAWINGS

FIG. 4 is a perspective view of the sweep elbow in accordance with the invention;

FIG. 5 is a front elevation view of the sweep elbow of FIG. 4;

FIG. 6 is a top plan view of the sweep elbow of FIG. 4;

FIG. 7 is a side elevation view of the sweep elbow of FIG. 4;

DETAILED DESCRIPTION OF THE INVENTION

The present invention relates generally to a sweep elbow used, for example, on the bottom wall of a portable tank, such as an intermediate bulk container (IBC), for transporting and storing materials, such as liquid materials. Particularly, the sweep elbow used on an IBC, with other appurtenances, aids in providing complete drainage after discharging is complete.

Figure 1:
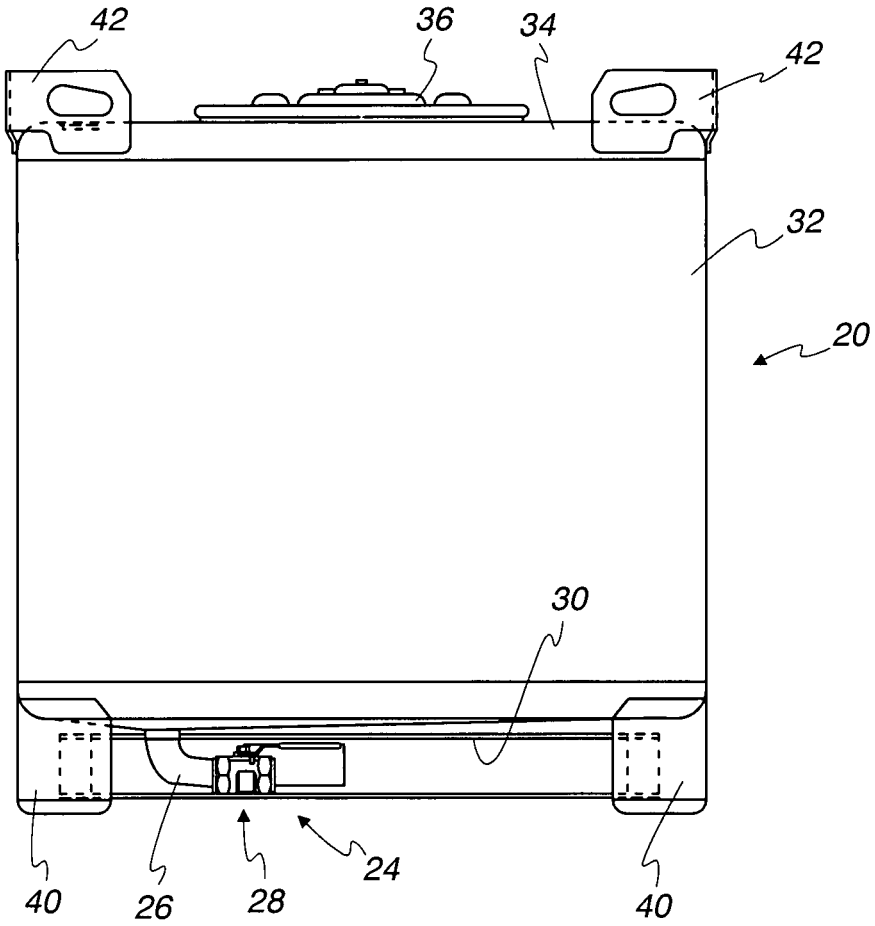
FIG. 1 is a front elevation view of an intermediate bulk container (IBC) including a discharge assembly having a sweep elbow in accordance with the invention.
Figure 2:
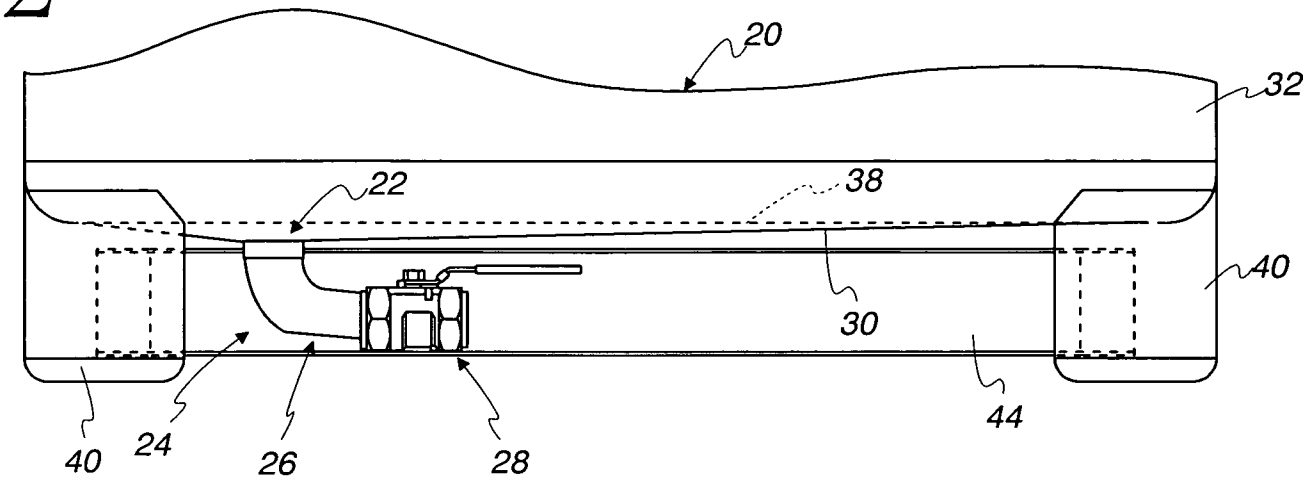
FIG. 2 is a partial side elevation view of the IBC of FIG. 1 illustrating the discharge assembly mounted to a bottom wall of the IBC.
Figure 3:
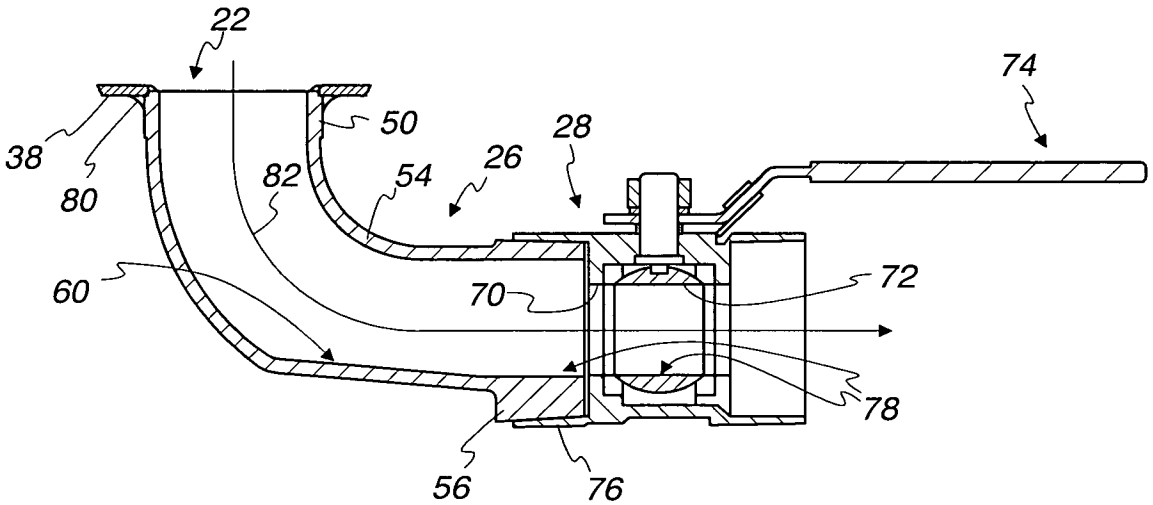
FIG. 3 is a cross section of the discharge assembly of the IBC of FIGS. 1 and 2.
Figure 8:
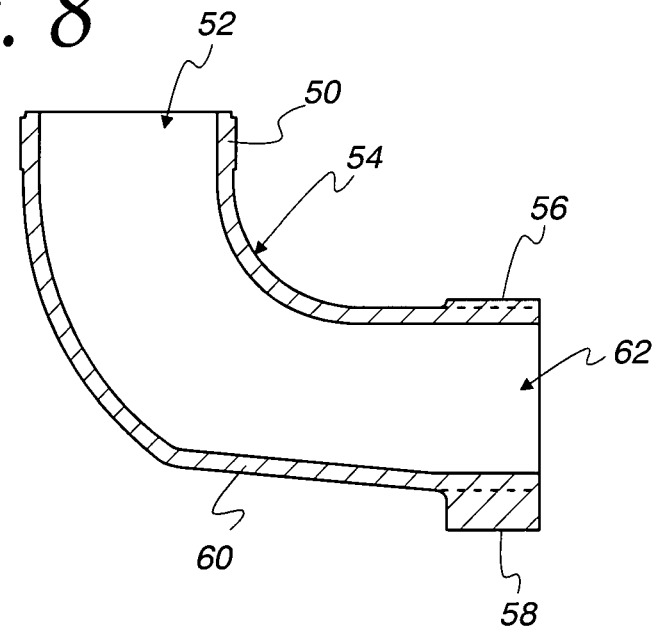
FIG. 8 is a sectional view taken along the line 8-8 of FIG. 6.
Figure 9:
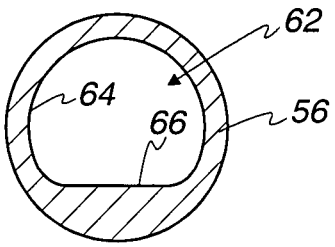
FIG. 9 is a sectional view taken along the line 9-9 of FIG. 7.
Figure 10:
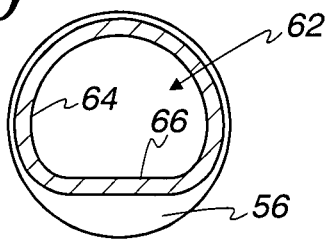
FIG. 10 is a sectional view taken along the line 10-10 of FIG. 7.

Referring to FIGS. 1 and 2, a portable tank 20, in the form of an IBC, includes a bottom discharge outlet 22, see FIG. 3, operatively connected to a discharge assembly 24 comprising a sweep elbow 26 in accordance with the invention and an outlet valve 28. The IBC 20 and outlet valve 28 may be of conventional construction.

The IBC 20 comprises a bottom wall 30, surrounded by a peripheral side wall 32 closed by a top wall 34. The top wall 34 includes a fill opening (not shown) closed by a cover 36. The bottom wall 30 includes creases, shown by dashed lines 38, so that the bottom wall 30 slopes toward the discharge outlet 22. Four formed legs 40 are provided at each corner of the bottom wall 30 to support the IBC 20 on a support surface or for stacking on another IBC. Lifting lugs 42 are provided at each corner of the top wall 34.

In the illustrated embodiment of the invention, the sweep elbow 26 is shown on an IBC 20 manufactured and sold by the assignee of the present invention under the trademark LIQUITOTE®. The LIQUITOTE® IBC is a steel container typically providing capacity in the range of 255 to 550 gallons, although some are as large as 793 gallons, and has a nominal width of 42 inches and nominal length of either 42 or 48 inches. The capacity is otherwise determined by height of the container, which is variable. Although the sweep elbow 26 is illustrated on the LIQUITOTE® IBC, the sweep elbow 26 could be used with other types of IBCs, portable tanks, or the like, as will be apparent skilled in the art. Such containers may provide capacity in the range of 120 to 793 gallons. Also, the IBC could be manufactured of rigid plastic or be of composite construction, as is known. As used herein, the term intermediate bulk container is intended to also refer more generally to portable tanks, as is known in the art.

In accordance with the invention, the sweep elbow 26 comprises a 2" cast sweep elbow of 316 stainless steel construction. In the illustrated embodiment the outlet valve 28 comprises a conventional 2" NPT ball valve.

Referring to FIGS. 4-10, the sweep elbow 26 is of one piece construction. As is apparent, materials other than 316 stainless steel could be used for the sweep elbow 26. The sweep elbow 26 includes an inlet flange 50 defining an inlet 52. The inlet flange 50 is cylindrical to define a circular cross sectional configuration at the inlet 52. Other configurations could be used at the inlet 52. The sweep elbow 26 comprises a continuous tubular element 54 from the inlet flange 52 to an outlet flange 56. As is known, the outlet flange 52 is perpendicular relative to the inlet flange owing to the 90 degree curvature of the tubular element 54. The outlet flange 56 includes an outer cylindrical wall 58. The cylindrical wall 58 may be threaded depending on the type of connection to the outlet valve 28, as will be apparent. The tubular element 54 is generally circular in cross section and provides a 90° turn to provide an elbow configuration, except that the tubular element 54 includes a bottom surface 60 that is generally planar and slopes downwardly toward the outlet flange 56. This construction defines a non-circular outlet 62. Particularly, and with reference to FIGS. 5, 9 and 10, the outlet 62 has a segment of a circle cross sectional configuration. This cross sectional configuration is defined as a plane figure bounded by a circular arc 64 and its chord 66.

In an illustrative embodiment of the invention the outlet flange 56 is machined to 2" NPT for connection to the outlet valve 28. The distance from the inlet 52 to a center line of the valve 28 is about 3 3/16", while a distance from a center line of the inlet 52 to the outlet 62 is about 4½". The outlet 62 has a horizontal diameter of 2" nominally, defined by the circular arc 64 and vertical diameter of about 1.6".

Referring to FIG. 3, the ball valve 28 comprises a valve opening 70 receiving a conventional ball 72 operated in a normal manner by a handle 74. The valve 28 includes a flange 76 receiving the sweep elbow outlet flange 56 with a conventional threaded connection. The valve opening 70 has a diameter of about 1.25", substantially smaller than an inner diameter of a conventional 2" NPT elbow. In accordance with the invention, the sweep elbow 26 is cast so that the planar bottom surface 60 is even with the ball valve through opening 70 and the interior of the ball 72, as illustrated by an arrow 78, see FIG. 3. The constant internal surface slope of the bottom surface 60 allows product to keep flowing towards the outlet valve 28. The bottom surface 60 being substantially even with the valve opening 70 at the bottom allows for better drainage and less product being trapped or setting in the elbow after discharging is complete, as would result from use of a conventional 2" NPT elbow.

The sweep elbow 26 is secured to the bottom wall 30 as by welding, as indicated at 80, see FIG. 3. Product flow from the IBC 20 through the sweep elbow 26 and the outlet valve 28 is illustrated by a line 82.

Thus, in accordance with the invention, the combination of the sloped bottom wall 30, and the sweep elbow 26 with the planar bottom surface 60 provides maximum drainage from the IBC 20, as will be apparent, and minimizes trapping or settling of material in the elbow 26 after discharging is complete.

We claim:

1. In an intermediate bulk container (IBC) for storing materials and including a bottom wall having a bottom discharge outlet and an outlet valve for connection to the discharge outlet, the improvement comprising:

a sweep elbow connected between the discharge outlet and the outlet valve, the sweep elbow having a circular cross sectional configuration at an inlet connected to the discharge outlet and having a segment of a circle cross sectional configuration at an outlet connected to the outlet valve.

2. The improvement of claim 1 wherein the segment of a circle defines a chord substantially tangential to a bottom of an opening of the outlet valve.

3. The improvement of claim 1 wherein the elbow has a bottom interior surface proximate the outlet substantially even with a valve opening inside the outlet valve.

4. The improvement of claim 3 wherein the bottom interior surface is generally planar and slopes downwardly toward the outlet.

5. The improvement of claim 1 wherein the sweep elbow is of stainless steel construction.

6. An apparatus comprising a bottom wall having a discharge outlet, a sweep elbow having an inlet connected to the discharge outlet and an outlet connected to an outlet valve, wherein a bottom interior surface of the sweep elbow proximate the sweep elbow outlet is substantially even with a valve opening inside the outlet valve.

7. The apparatus of claim 6 wherein the sweep elbow has a circular cross sectional configuration at the inlet connected to the discharge outlet and having a segment of a circle cross sectional configuration at the outlet connected to the outlet valve.

8. The apparatus of claim 7 wherein the segment of a circle defines a chord substantially tangential to a bottom of an opening of the outlet valve.

9. The apparatus of claim 6 wherein the bottom interior surface is generally planar and slopes downwardly toward the outlet.

10. The apparatus of claim 6 wherein the sweep elbow is of stainless steel construction.

11. The apparatus of claim 6 wherein the outlet valve comprises a ball valve.

12. An intermediate bulk container (IBC) for storing materials comprising:

a portable tank including a bottom wall having a bottom discharge outlet; and a discharge assembly comprising a sweep elbow and an outlet valve, the sweep elbow having an inlet connected to the discharge outlet and an outlet connected to the outlet valve, wherein a bottom interior surface of the sweep elbow proximate the sweep elbow outlet is substantially even with a valve opening inside the outlet valve.

13. The IBC of claim 12 wherein the sweep elbow has a circular cross sectional configuration at the inlet connected to the discharge outlet and having a segment of a circle cross sectional configuration at the outlet connected to the outlet valve.

14. The IBC of claim 13 wherein the segment of a circle defines a chord substantially tangential to a bottom of an opening of the outlet valve.

15. The IBC of claim 12 wherein the bottom interior surface is generally planar and slopes downwardly toward the outlet.

16. The IBC of claim 12 wherein the sweep elbow is of stainless steel construction.

17. The IBC of claim 12 wherein the outlet valve comprises a ball valve.

18. The IBC of claim 12 wherein the bottom wall is sloped toward the discharge outlet.

19. The IBC of claim 12 wherein the portable tank comprises a steel tank.

20. The IBC of claim 12 wherein the portable tank comprises a tank having a capacity in the range of about 120 to 793 gallons.

* * * * *